US006299938B1

(12) United States Patent
Tateyama

(10) Patent No.: US 6,299,938 B1
(45) Date of Patent: Oct. 9, 2001

(54) APPARATUS AND METHOD OF APPLYING RESIST

(75) Inventor: Kiyohisa Tateyama, Kumamoto (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/438,495

(22) Filed: Nov. 12, 1999

(30) Foreign Application Priority Data

Nov. 20, 1998 (JP) ..... 10-346638

(51) Int. Cl.[7] ..... B05D 3/12

(52) U.S. Cl. ..... 427/240; 427/425; 427/389.7; 118/52; 118/320; 118/663; 118/683

(58) Field of Search ..... 427/240, 425, 427/385.5, 389.7; 118/52, 320, 663, 683

(56) References Cited

U.S. PATENT DOCUMENTS 5,066,616 * 11/1991 Gordon ..... 437/229
5,658,615 * 8/1997 Hasebe et al. ..... 427/240

FOREIGN PATENT DOCUMENTS 64-64218 3/1989 (JP) .
1-249162 10/1989 (JP) .
2-131237 5/1990 (JP) .

* cited by examiner

*Primary Examiner*—Shrive P. Beck
*Assistant Examiner*—Jennifer Calcagni
(74) *Attorney, Agent, or Firm*—Rader, Fishman & Grauer

(57) ABSTRACT

A resist solution applying apparatus and a method of using the resist solution applying apparatus. The apparatus comprises a hold and rotate member that holds and rotates a member to be processed, a resist solution discharge nozzle that discharges a resist solution almost at a center of rotation of the member to be processed, a resist solution supply mechanism that supplies the resist solution to the resist solution discharge nozzle, and a discharge controller connected to the rest solution supply mechanism that controls a predetermined amount of the resist solution discharged from the resist solution discharge nozzle to be reduced gradually or in stages after discharge is started, and increased again before the discharge is stopped.

14 Claims, 4 Drawing Sheets

APPARATUS AND METHOD OF APPLYING RESIST

BACKGROUND OF THE INVENTION

The present invention generally relates to an apparatus and method of applying a resist solution onto a glass substrate used in, for example, a liquid crystal display (LCD).

The priority of the present application has been claimed on the basis of Japanese Patent Application No. 10/346638 (Nov. 20, 1998). The contents of the Japanese application are incorporated in the present application.

In a producing process of an LCD, the same photolithography as that employed for production of a semiconductor device is employed to form a thin film of ITO (Indium Tin Oxide) and an electrode pattern on a glass substrate for the LCD. According to the photolithography, photoresist is applied onto a substrate, exposed and developed.

In a major resist applying step, spin coating is employed. By the spin coating, a resist solution is dropped onto a glass substrate while rotating the glass substrate, and the resist solution is diffused by the rotationally centrifugal force, to form a uniform resist film on a glass substrate. According to this method, however, most of the resist solution may be dropped from the substrate and wasted. An example teaches that only about 10% of the total amount of the resist contribute to formation of the film.

BRIEF SUMMARY OF THE INVENTION

The present invention is accomplished to solve the above problem, and its object is to provide an apparatus and method capable of reducing an amount of use of a solution.

To solve the problem, the present invention according to its first major concept is a resist solution applying apparatus, comprising a holding and rotating member for rotating while holding a member to be processed; a resist solution discharging nozzle for discharging a resist solution almost at a center of rotation of the member to be processed; a resist solution supplying mechanism for supplying the resist solution to the resist solution discharging nozzle; and a discharge control section connected to the resist solution supplying mechanism, for controlling an amount of the resist solution discharged from the resist solution discharging nozzle to be reduced gradually or in stages, after discharging has been started.

According to this structure, a resist solution extends all over the member to be processed by the centrifugal force after discharging has been started, and a resist solution is further discharged on the extending resist solution. The resist solution discharged after that is easily extended to have a uniform thickness even if an amount of the discharging is reduced. Therefore, even if the amount of discharge is reduced after discharging has been started, the resist solution can be applied all over the member to be processed to have a uniform thickness, and the use of the resist solution can be reduced as compared with that in prior art.

It is preferable that the embodiment comprises a casing for sealing airtight an atmosphere around the member to be processed, while the resist solution is discharged or the member to be processed is rotated. According to the structure, the solvent included in the resist solution is hardly vaporized. Therefore, the advantage of controlling the discharge can be achieved certainly. Further, the supply of the resist solution can be reduced. In this case, it is preferable that the member to be processed and its casing are rotated synchronously with one another. According to this structure, the solvent included in the resist solution ca be made to be vaporized further hardly.

According to the embodiment of the first concept, the discharge control portion controls an amount of the resist solution discharged from the resist solution discharging nozzle to be a predetermined amount in a period from the time when discharging is started to the time when the resist solution has extended all over the member to be processed, and then controls the amount to be gradually reduced.

According to the embodiment of the first concept, the discharge control portion controls an amount of the resist solution discharged to the resist solution discharging nozzle to be a predetermined amount in a period from the time when discharging is started to the time when the resist solution has extended all over the member to be processed, and then controls the amount to be gradually reduced, and further controls the amount to be increased again.

The present invention of the second major concept, in addition to the first concept, provides a resist solution applying apparatus further comprising a rotation speed control portion for controlling a rotation speed of the member to be processed determined by the holding and rotating member, synchronously with the control of the amount of discharge by the discharge control portion.

According to this structure, even when the discharge of the resist solution is limited, the solution can be applied uniformly onto the entire member to be processed.

According to the embodiment of the second concept, the rotation speed control portion controls the rotation speed of the member to be processed determined by the holding and rotating member, to be constant, at least when the amount of the resist solution discharged to the resist solution discharging nozzle is controlled to be reduced gradually.

According to the embodiment of the second concept, the discharge control portion controls an amount of the resist solution discharged from the resist solution discharging nozzle to be a predetermined amount in a period from the time when discharging is started to the time when the resist solution has extended all over the member to be processed, and then controls the amount to be gradually reduced; and the rotation speed control portion controls the rotation speed of the member to be processed determined by the holding and rotating member, to be accelerated when the amount of the resist solution discharged to the resist solution discharging nozzle is a predetermined amount, and controls the rotation speed to be constant when the amount of the resist solution is controlled to be reduced gradually.

According to the embodiment of the second concept, the discharge control portion controls an amount of the resist solution discharged to the resist solution discharging nozzle to be a predetermined amount in a period from the time when discharging is started to the time when the resist solution has extended all over the member to be processed and then controls the amount to be gradually reduced, and further controls the amount to be increased again; and the rotation speed control portion controls the rotation speed of the member to be processed determined by the holding and rotating member, to be accelerated when the amount of the resist solution discharged to the resist solution discharging nozzle is a predetermined amount, controls the rotation speed to be constant when the amount of the resist solution is controlled to be reduced gradually, and controls the rotation speed to be decelerated when the amount of the resist solution is controlled to be increased again.

The present invention according to the third concept provides a method of applying a resist solution, comprising the steps of supplying the resist solution to a member to be processed; extending the resist solution on the member to be processed by rotating the member to be processed in a sealed casing; and controlling an amount of the resist solution discharged onto the member to be processed, to be reduced gradually or in stages after discharging has started.

The present invention according to the fourth concept, in addition to the third concept, provides the method further comprising a step of controlling a rotation speed of the member to be processed, synchronously with the control of the amount of the discharged resist solution.

The present invention according to the fifth concept provides a resist solution applying apparatus, comprising: a holding and rotating member for rotating while holding a member to be processed; a casing for sealing airtight an atmosphere around the member to be processed, while the member to be processed is rotated; a resist solution discharging nozzle for discharging a resist solution almost at a center of rotation of the member to be processed; a resist solution supplying mechanism for supplying the resist solution to the resist solution discharging nozzle; and a discharge control section connected to the resist solution supplying mechanism, for varying an amount of the resist solution discharged from the resist solution discharging nozzle, after discharging has been started.

The other characteristics and advantages of the present invention can be further understood by a person skilled in the art, from the following drawings and preferred embodiment.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will be described below with reference to the drawings.

Figure 1:
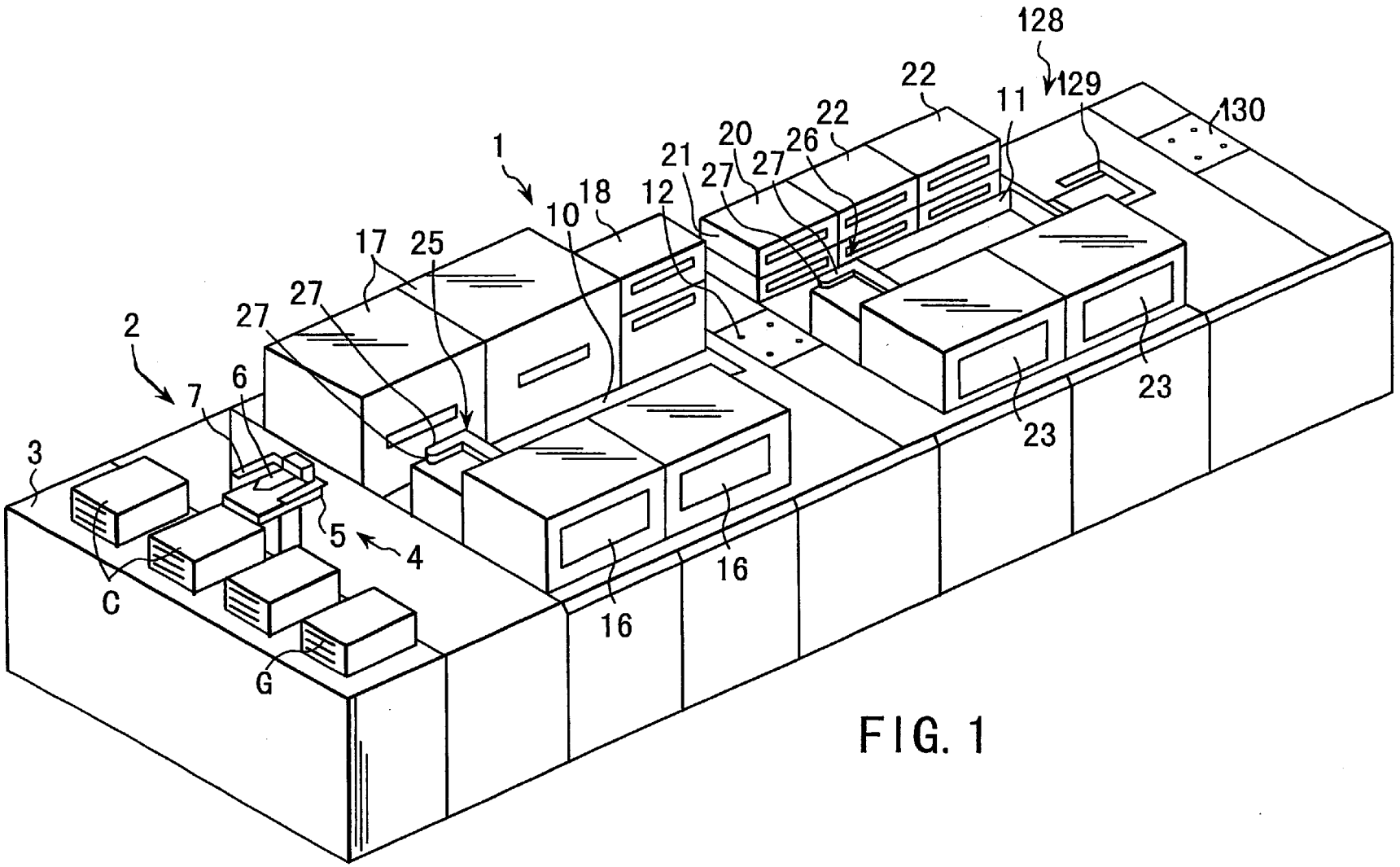
FIG. 1 is a perspective view of a resist applying/developing system according to an embodiment of the present invention.

FIG. 1 is a perspective view of a resist applying/developing system according to the embodiment of the present invention.

As shown in FIG. 1, a loader/unloader portion 2 for loading/unloading a glass substrate G in/from the resist applying/developing system 1 is provided in front of (at the left side, in the figure, of) the resist applying/developing system 1. A cassette table 3 on which cassettes C each containing, for example, twenty five glass plates G are aligned and placed at predetermined positions, and a loader-unloader 4 for unloading a glass substrate G to be processed from each cassette C and loading again the glass substrate G which has been processed in the resist applying/developing system 1 into each cassette C, are provided at the loader/unloader portion 2.

The loader-unloader 4 is moved in the aligning direction of the cassettes C by the run of a main body 5, and a glass substrate G is unloaded from each cassette C by a plate-like pin set 6 mounted on the main body 5 and loaded again into each cassette C. A substrate positioning member 7 for holding and positioning four corners of a glass substrate G is provided at both sides of the pin set 6.

Corridor-like transfer paths 10 and 11 arranged in the longitudinal direction are provided in a straight line via a first acceptance portion 12, at the central part of the resist applying/developing system 1. Various processing devices 16 to 23 for executing the processings about the glass substrates G are arranged at both sides of the transfer paths 10 and 11. At one side of the transfer path 10, for example, two cleaning devices 16 for brushing a glass substrate G and cleaning it by high-pressure jet water are provided. At the opposite side of the transfer path 10, two developing devices 17 are provided, and two heating devices 18 are piled up beside the developing devices 17.

At one side of the transfer path 11, an adhesion device 20 for subjecting the glass substrate G in the hydrophobic process before applying the resist solution onto the glass substrate G is provided, and a cooling device 21 is arranged under the adhesion device 20. In addition, heating devices 22 are stacked in two rows, two in each row, beside the adhesion device 20 and the cooling device 21. At the opposite side of the transfer path 11, resist applying devices 23 for applying the resist solution onto the surface of the glass substrate G to form a resist film thereon are arranged. An exposing device and the like for exposing a predetermined fine pattern on the resist film formed on the glass substrate G via a second acceptance portion 128 are provided at the side portion of the resist applying device 23, though not shown in the figure. The second acceptance portion 128 comprises an outgoing/incoming pin set 129 for allowing the glass substrate G to outgo/income, and an acceptance table 130.

The above processing devices 16–18 and 20–23 are arranged at both sides of the transfer paths 10 and 11, so that their inlet/outlet openings of the glass substrate G face inwardly. A first transfer device 25 moves in the transfer path 10 between the loder/unloader device 2, the processing devices 16–18 and the first acceptance device 12 to transfer the glass substrate G. A second transfer device 26 moves in the transfer path 11 between the first acceptance device 12, the second acceptance device 28, and the processing devices 20–23 to transfer the glass substrate G.

Each of the transfer devices 25 and 26 has a pair of upper and lower arms 27, 27. When it accesses the processing devices 16–18 and 20–23, the processed glass substrate G is carried out of the chamber of each processing device by one of the arms 27 and the pre-processed glass substrate G is carried into the chamber by another arm 27.

Figure 2:
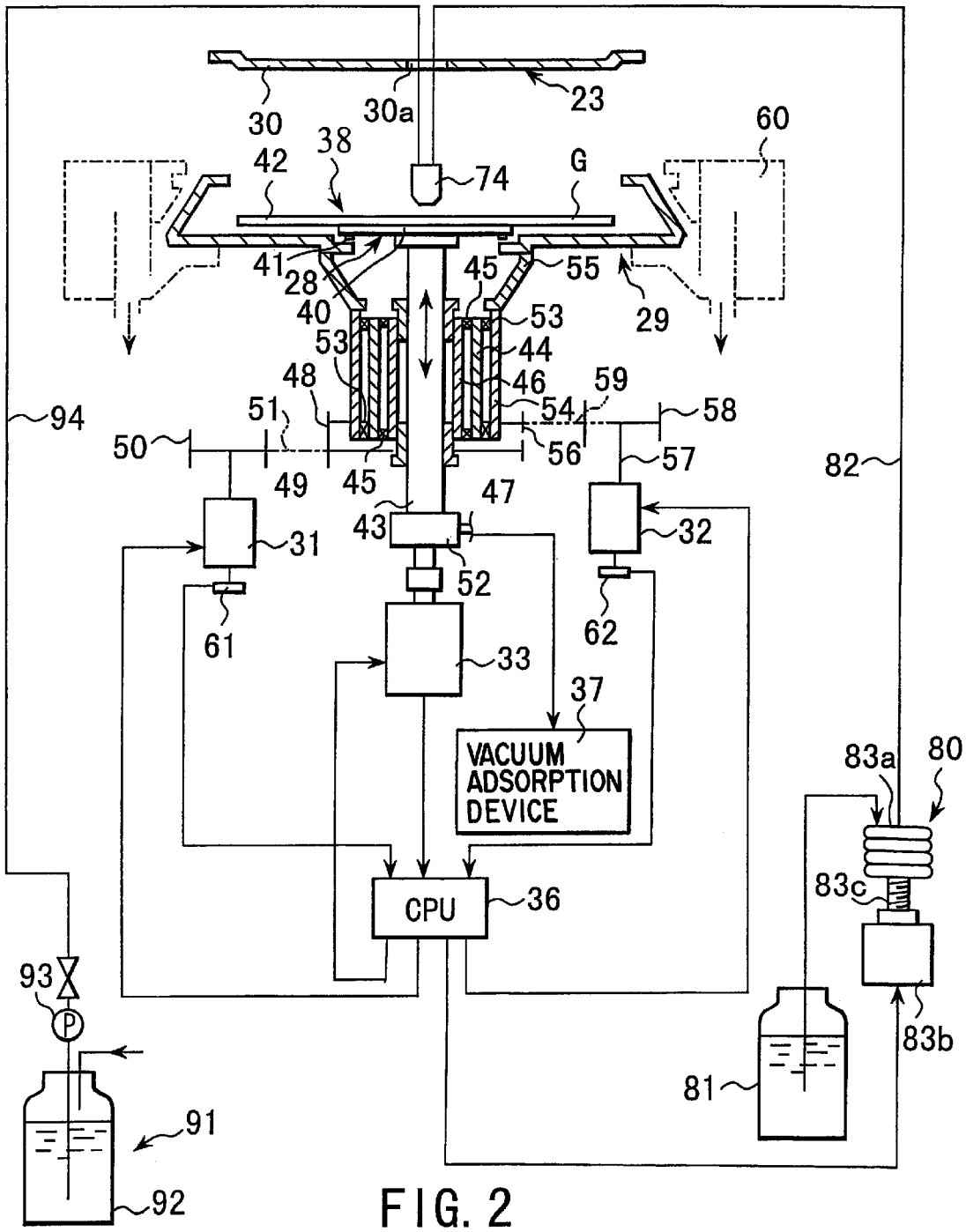
FIG. 2 is a front view of the resist applying apparatus shown in FIG. 1.
Figure 3:
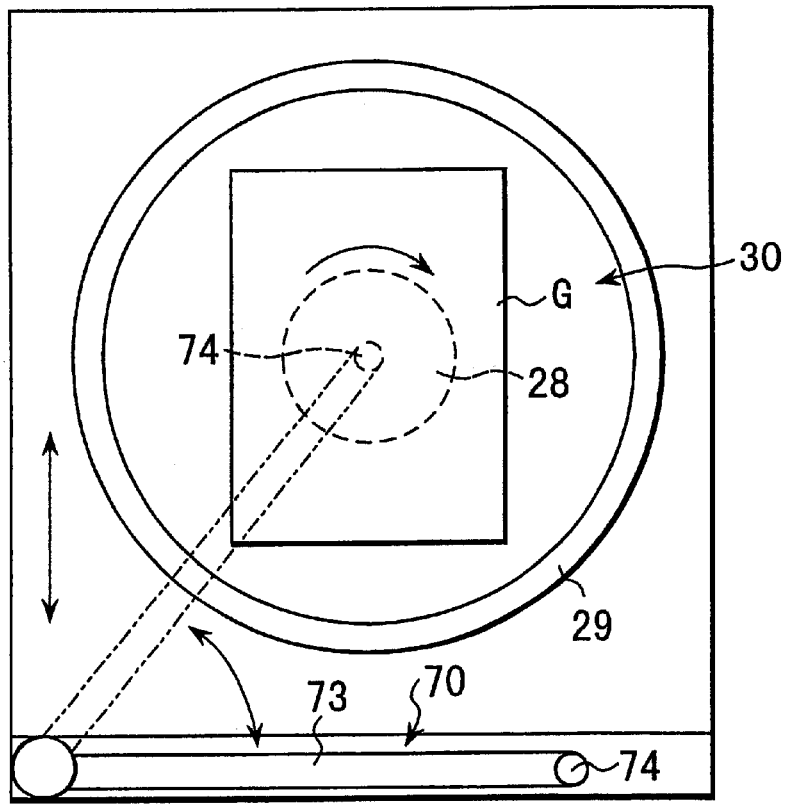
FIG. 3 is a plan view of the resist applying apparatus shown in FIG. 1.
Figure 4:
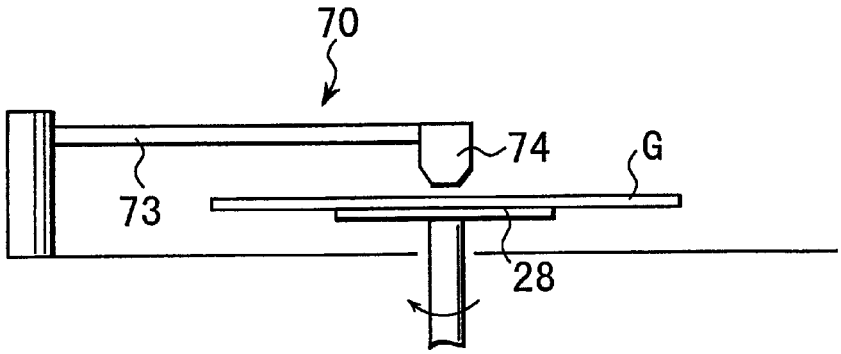
FIG. 4 is a side view showing essential parts of the resist applying apparatus shown in FIG. 1.

FIG. 2 is a front view and FIG. 3 is a plan view, showing the resist applying device 23 shown in FIG. 1. FIG. 4 is a side view showing essential portions thereof.

As shown in the figures, a cup 29 is arranged almost at the center of the resist applying device 23, and a spin chuck 28 serving as a holding and rotating member for holding the glass substrate G is arranged inside the cup 29.

A vacuum adsorption device 37 for holding the glass substitute G in the vacuum adsorption is connected to the spin chuck 28. An opening portion 38 through which the glass substrate G is taken in/out is provided at the upper portion of the cup 29. A lid 30 covers the openinng portion 38. The lid 30 is supported to be moved up and down by an opening/closing mechanism (not shown). An insertion aperture 30*a* through which a nozzel 74 to be described later is inserted into the cup 29 is formed at the lid 30.

A first motor 31 is a driving source for rotating the spin chuck 28, and a second motor 32 is a driving source for rotating the cup 29. An elevating cylinder 33 is a driving source for moving up and down the spin chuck 28 in the direction of axis Z.

A sealing member 41 is attached to a bottom surface of an outer periphery side of a table portion 40 of the spin chuck 28. When the sealing member 41 abuts on the bottom portion of the cup 29 by lowering the spin chuck 28, an air-tight processing space 42 is formed.

The first motor 31 and the second motor 32 are controlled to rotate by a CPU 36. The elevating cylinder 33 is controlled to move up and down by the CPU 36.

A rotation shaft 43 of the elevating cylinder 33 is slidably connected to a spline bearing 47, which is fitted on a circumferential surface of a rotation cylinder 46 mounted rotatably on an inner peripheral surface of a fixed collar 44 via a bearing 45. A follower pulley 48 is mounted on the spline bearing 47, and a timing belt 51 bridges between the follower pulley 48 and a driving pulley 50 mounted on a driving shaft 49 of the first motor 31.

Therefore, the rotation shaft 43 is rotated by the drive of the first motor 31 via the timing belt 51 and thereby the spin chuck 28 is rotated.

The lower side of the rotation shaft 43 is provided in a cylindrical body (not shown). In the cylindrical body, the rotation shaft 43 can be moved in a direction of axis Z by the drive of the elevating cylinder 33 via a vacuum sealing portion 52.

The cup 29 is provided via a connection cylinder 55 fixed at an upper end portion of a rotary outer cylinder 54 mounted on an outer peripheral surface of the fixed collar 44 via a bearing 53. The drive from the second motor 32 is transmitted to the cup 29 by a timing belt 59 bridging between a follower pulley 56 mounted on the rotary outer cylinder 54 and a driving pulley 58 mounted on a driving shaft 57 of the second motor 32, and thus the cup 29 is rotated horizontally.

In addition, a drain cup 60 shaped in a hollow ring is arranged at the outer peripheral side of the cup 29, so as to collect mist flying from the cup 29.

Further, an encoder 61 is attached to the first motor 31, and an encoder 62 is attached to the second motor 32. Detection signals detected by the encoders 61 and 62 are transmitted to the CPU 36. In accordance with output signals compared in the CPU 36, the rotation of the first motor 31 and the second motor 32 is controlled.

As shown in FIG. 3, a supply mechanism 70 for supplying thinner and the resist solution onto the glass substrate G is arranged outside the cup 29. The supply mechanism 70 comprises a pivoting member 73 pivoted by a driving mechanism (not shown), and a supply head 74 having nozzles for supplying thinner and the resist solution almost at the center of the rotation of the glass substrate G is attached to the top portion of the pivoting member 73.

Next, a solution supplying mechanism 80 for controlling the supply of the resist solution to the above-mentioned supply head 74 will be explained. The solution supplying mechanism 80 comprises a storage portion 81 of the resist solution and a pipe 82 for connecting the storage portion 81 to the supply head 74, and a discharge control portion 83 is provided at the solution supplying mechanism 80. Specifically, the discharge control portion 83 can be constituted to comprise, for example, a bellows pump 83*a* intervening in the pipe 82, a stepping motor 83*b* for controlling the drive of the bellows pump 83*a*, and a ball screw mechanism 83*c* provided between the bellows pump 83*a* and the stepping motor 83*b* to convert the rotary motion of the stepping motor 83*b* into a straight motion and operate the bellows pump 83*a*, as shown in the figure. According to this structure, the operation of the bellows pump 83*a* can be controlled and the amount of the resist solution supplied to the supply head 74 can be also controlled, by varying the number of the pulse signals which are to be input to the stepping motor 83*b* by the CPU 36. However, this is only an example and, the amount of discharge from the supply head 74 can be also controlled by providing a flow control valve (not shown) in the pipe 82.

Moreover, a thinner supply mechanism 91 for supplying a thinner onto the glass substrate G prior to the supply of the resist solution, to improve the wetness, allow the resist solution to be applied more thinly and thus reduce the use of the resist solution, is provided for the resist applying apparatus 23 according to the present embodiment. The thinner supply mechanism 91, which is constituted to supply the thinner from a thinner supply source (not shown) to a storage portion 92, feeds the thinner onto the glass substrate G, from the supply head 74 provided on the glass substrate G via a pump 93 and a pipe 94.

Next, the operations of the above-constituted resist applying apparatus 23 will be explained. Where the spin chuck 28 is moving up above the opening portion 38 of the cup 29, the glass substrate G is moved onto the spin chuck 28 from the transfer device 26 and the vacuum adsorption is kept.

Then, the spin chuck 28 is lowered and the glass substrate G is transferred into the cup 29 through the opening portion 38, by the drive of the elevating cylinder 33. After that, the lid 30 is lowered to cover the cup 29.

Then, the pivoting member 73 is pivoted, the supply head 74 at the top end of the pivoting member 73 is set at the position corresponding substantially to the center of the glass substrate G, and the top end is positioned in the cup 29 through the insertion aperture 30*a* of the lid 30. At this time, the space between the outer periphery of the supply head 74 and the inner wall of the insertion aperture 30*a* is sealed air-tightly.

The spin chuck 28 starts rotating by the first motor 31 and, simultaneously, supply of the resist solution from the supply head nozzle 74 is started. At this time, the thinner may be supplied in advance onto the glass substrate G, from the storage portion 92 storing the thinner fed from the thinner supply source, via the pipe 94, prior to the application of the resist solution. With this operation, the wetness of the resist solution on the glass substrate G can be improved, the resist solution can be applied more thinly and, therefore, the amount of the used resist solution can be reduced.

The amount of the resist solution discharged from the supply head 74 is controlled as shown in FIG. 5, by the discharge control portion 83 provided at the above-described resist solution supply mechanism 80. According to the control shown in FIG. 5A, the amount of discharge is maximum when the discharge from the resist solution discharge nozzle 74 is started, and the amount is reduced gradually after the start of the discharge. When the resist solution is discharged onto the glass substrate G, the resist solution extends outwardly by the centrifugal force generated with the rotation of the spin chuck 28, but the resist solution discharged after this is discharged on the extending resist solution and thus can be extended easily. Therefore, according to this manner, waste of the resist solution can be prevented and the resist solution can be applied in a uniform thickness, as compared with a conventional case of supplying the resist solution at a constant amount. At this time, since the atmosphere around the glass substrate G in the cup 29 is sealed airtight by the lid 30, the solvent included in the resist solution is hardly vaporized and, for this reason, the viscosity of the resist solution is not changed so much. Therefore, the amount of the discharged resist solution can be reduced more effectively.

Figure 5A:
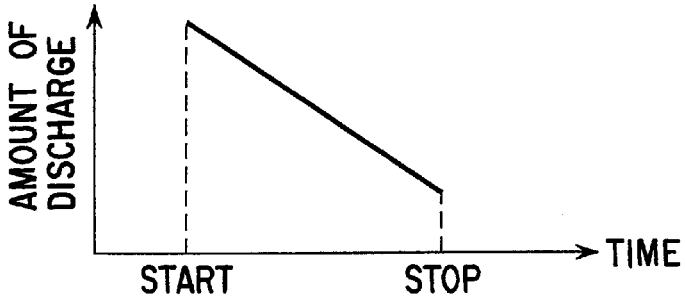
FIG. 5A–5D are graphs to explain the control of the discharge of the resist solution by a discharge control portion.
Figure 5B:
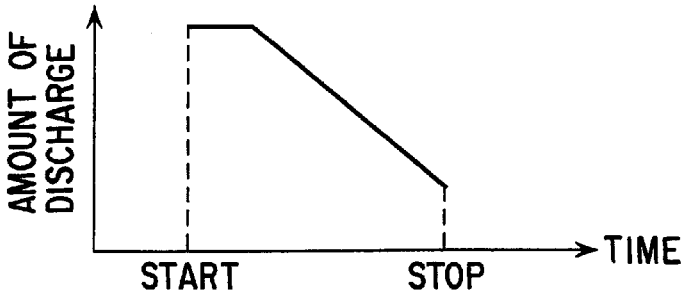

On the other hand, according to the control shown in FIG. 5B, the resist solution is supplied at an amount more than a predetermined one from the resist solution discharge nozzle 74 during a predetermined period, or more specifically, during a period until the resist solution extends entirely over the glass substrate G and, after that, the amount of discharged resist solution is reduced gradually. According to this manner, since the resist solution is discharged at an amount more than a predetermined one until the resist solution extends certainly over the entire glass substrate G, the resist solution can extend easily to the outer peripheral portion of the glass substrate G. On the other hand, after the resist solution has extended entirely over the glass substrate G, the resist solution discharged after that works to make the thickness of the resist film uniform. Therefore, no problem is caused even when the amount of discharge is reduced, and the amount of use thereof can be reduced as compared with the conventional case.

Figure 5C:
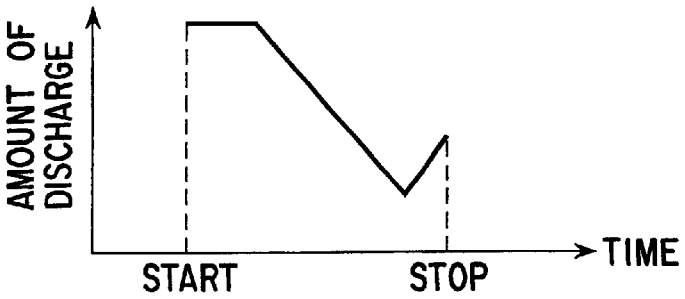
Figure 5D:
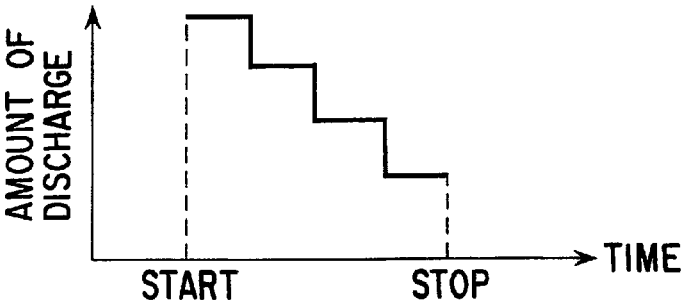

The control shown in FIG. 5C is the same as that in FIG. 5B with respect to the feature of discharging much solution in the step of extending the resist solution over the glass substrate G, and reducing the discharge in the step of adjusting the film thickness uniformly, but is different in the feature of controlling to increase the discharge again before the discharge has been stopped. That is, in a case where the discharge is reduced gradually as the time to stop the discharging comes, as shown in FIGS. 5A and 5B, a lake of the resist solution may be generated at the outer peripheral portion of the glass substrate G because the discharge becomes reduced. If the amount of discharge is increased again before the discharging has been stopped, the solution flows and the lake disappears, and therefore, the thickness of the resist solution can be made uniform over the glass substrate G. The amount of discharge can be reduced in stages as shown in FIG. 5D.

Figure 6:
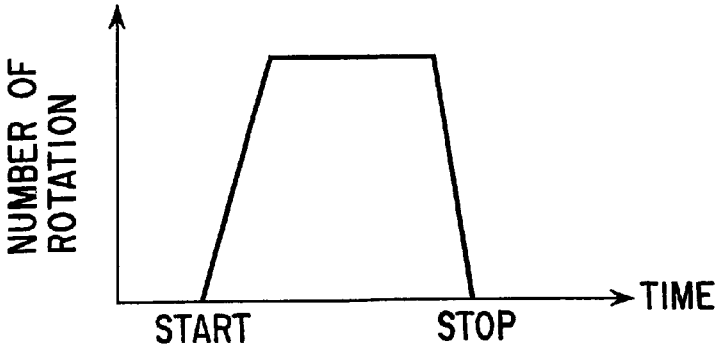
FIG. 6 is a graph to explain the control of the rotational amount of a spin chuck by a rotational amount control mechanism.

In addition, it is preferable that the CPU 36 constituting the rotation control mechanism of the spin chuck 28 serving as a holding and rotating member controls the discharge from the resist solution discharging nozzle 74 and also controls the rotary speed of the spin chuck 28. With this operation, even when the amount of the discharged resist solution is controlled, the thickness of the resist solution can be certainly made uniform over the glass substrate G, which contributes to the reduction of use of the resist solution. For example, when the discharging is controlled as shown in FIGS. 5B and 5C, it is preferable that the discharging is accelerated to extend the resist solution over the glass substrate G while it is discharged at an amount more than a predetermined one, and the spin chuck 28 is rotated at a constant speed to easily make the thickness uniform while the amount of discharge is gradually reduced, i.e. the thickness of the solution is adjusted to be uniform, as shown in FIG. 6. Once the thickness of the resist solution is uniform, the rotation of the first motor 31 is gradually decelerated.

After that, the rotation of the first motor 31 is stopped and thus the rotation of the glass substrate G is stopped. Subsequently, the supply head 74 is moved up and taken from within the cup 29, and the pivoting member 73 is pivoted to the outside of the cup 29. Therefore, the supply head 74 is moved to a standby position outside the cup 29. At this time, the lid 30 keeps covering the opening portion 38 of the cup 29.

The first motor 31 and the second motor 32 are rotated synchronously, and the spin chuck 28, the cup 29, the lid 30 and the glass substrate G are rotated integrally. As a result, the resist solution applied onto the glass substrate G is dried and the resist film is formed on the glass substrate G.

After that, the rotation of the first motor 31 and the second motor 32 is stopped, the integral rotation of the spin chuck 28, the cup 29, the lid 30 and the glass substrate G is stopped, and the lid 30 is moved up and the opening potion 38 is opened by an opening/closing mechanism (not shown).

Then, when the spin chuck 28 is moved up by the drive of the elevating cylinder 33, the glass substrate G is transferred outside the cup 29 through the opening portion 38 and is moved from the spin chuck 28 to the transfer device 26.

The present invention is not limited to the above-described embodiment, and can be variously modified within a range which does not change the gist of the invention.

For example, only the spin chuck is rotated when the resist solution is discharged (or when the thinner is supplied), bur the embodiment is not limited to this. The spin chuck 28, the cup 29, the lid 30 and the glass substrate G may be rotated integrally, by rotating the first motor 31 and the second motor 32 synchronously while supplying the resist solution from the supply head 74. In this structure, when the glass substrate G is rotated, the atmosphere around the glass substrate G in the cup 29 can be prevented from rotating relatively to the glass substrate G. Therefore, the discharge of the resist solution can be controlled so that the solvent can be hardly vaporized from the resist solution. Thus, extension of the resist solution can be controlled more exactly. Therefore, the amount of the discharged resist solution can be reduced to a small one.

Further, for example, the present invention is applied to the resist solution applying apparatus in the above-described embodiment. Naturally, however, the present invention can be applied to an apparatus for applying other solutions, and also, applied not only to the glass substrate, but also to other processed members.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A resist solution applying apparatus, comprising:

a hold and rotate member that holds and rotates a member to be processed;

a resist solution discharge nozzle that discharges a resist solution almost at a center of rotation of said member to be processed;

a resist solution supply mechanism that supplies the resist solution to said resist solution discharge nozzle; and a discharge controller connected to said resist solution supply mechanism, that controls a predetermined amount of the resist solution discharged from said resist solution discharge nozzle to be reduced gradually or in stages after discharge is started, and increased again before the discharge is stopped, such that the resist solution flows and causes a lake of the resist solution, which was formed at an outer peripheral portion of the member to be processed, to disappear.

2. A resist solution applying apparatus according to claim 1, further comprising a casing that seals an airtight atmosphere around the member to be processed, while said resist solution is discharged or the member to be processed is rotated.

3. A resist solution applying apparatus according to claim 2, further comprising a casing rotating mechanism that rotates said casing synchronously with the rotating of the member to be processed.

4. A resist solution applying apparatus according to claim 1, wherein said discharge controller controls an amount of the resist solution discharged from said resist solution discharge from said resist solution discharge nozzle to be a predetermined amount in a period from the time when discharge is started to the time when the resist solution has extended all over the member to be processed, and then controls the amount to be gradually reduced.

5. A resist solution applying apparatus according to claim 1, further comprising a rotation speed controller that controls a rotation speed of the member to be processed determined by said hold and rotate member, synchronously with the control of the amount of discharge by said discharge controller.

6. A resist solution applying apparatus according to claim 5, wherein said rotation speed controller controls the rotation speed of the member to be processed determined by said hold and rotate member, to be constant, at least when the amount of the resist solution discharged to said resist solution discharge nozzle is controlled to be reduced gradually.

7. A resist solution applying apparatus according to claim 5, wherein said discharge controller controls an amount of the resist solution discharged from said resist solution discharge nozzle to be a predetermined amount in a period from the time when discharging is started to the time when the resist solution has extended all over the member to be processed, and then controls the amount to be gradually reduced; and said rotation speed controller controls the rotation speed of the member to be processed determined by said hold and rotate member, to be accelerated when the amount of the resist solution discharged by said resist solution discharge nozzle is a predetermined amount, and controls the rotation speed to be constant when the amount of the resist solution is controlled to be reduced gradually.

8. A resist solution applying apparatus according to claim 5, said rotation speed controller controls the rotation speed of the member to be processed determined by said hold and rotate member to be constant when the amount of the resist solution is controlled to be reduced gradually, and controls the rotation speed to be decelerated when the amount of the resist solution is controlled to be increased again.

9. A method of applying a resist solution, comprising the steps of:

supplying the resist solution to a member to be processed;

extending the resist solution on the member to be processed by rotating the member to be processed in a sealed casing; and controlling a predetermined amount of the resist solution discharged onto the member to be processed, to be reduced gradually or in stages after discharging is started, and to be increased before the discharging is stopped, such that the resist solution flows and causes a lake of the resist solution, which has been generated at an outer peripheral portion of the member to disappear.

10. A method according to claim 9, wherein in the step of controlling the amount of the discharged resist solution, the amount of the resist solution discharged onto the member to be processed is controlled to be a predetermined amount in a period from the time when discharging is started to the time when the resist solution extends all over the member to be processed, and then controlled to be reduced gradually.

11. A method according to claim 10, further comprising a step of controlling a rotation speed of the member to be processed, synchronously with the control of the amount of the discharged resist solution.

12. A method according to claim 11, wherein in the step of controlling the rotation speed of the member to be processed, at least, when the amount of the resist solution discharged onto the member to be processed is reduced gradually, the rotation speed of the member to be processed is controlled to be constant.

13. A method according to claim 11, wherein in the step of controlling the amount of the discharged resist solution, the amount of the resist solution discharged onto the member to be processed is controlled to be a predetermined amount in a period from the time when discharging is started to the time when the resist solution extends all over the member to be processed, and then controlled to be reduced gradually; and in the step of controlling the rotation speed of the member to be processed, the rotation speed of the member to be processed is controlled to be accelerated when the amount of the resist solution discharged onto the member to be processed is controlled to be a predetermined amount, and the rotation speed is controlled to be constant when the amount of the resist solution is controlled to be reduced gradually.

14. A method according to claim 11, wherein in the step of controlling the rotation speed of the member to be processed, the rotation speed of the member to be processed is controlled to be constant when the amount of the resist solution is controlled to be reduced gradually, and further the rotation speed is controlled to be decelerated when the amount of the resist solution is controlled to be increased again.

* * * * *